US005836528A

United States Patent [19]

Hilgarth

[11] Patent Number: 5,836,528

[45] Date of Patent: Nov. 17, 1998

[54] CHIPPER

[75] Inventor: Günter Hilgarth, Leutershausen, Germany

[73] Assignee: Steinmax Werkzeuge GmbH, Ansbach, Germany

[21] Appl. No.: 742,375

[22] Filed: Nov. 1, 1996

[30] Foreign Application Priority Data

Mar. 27, 1996 [DE] Germany ..... 196 12 024.1

[51] Int. Cl.[6] ..... B02C 18/16

[52] U.S. Cl. ..... 241/93; 144/172; 241/101.78

[58] Field of Search ..... 241/93, 101.78, 241/241, 241.5, 237, 239, 224, 242; 144/172, 375, 162.1

[56] References Cited

U.S. PATENT DOCUMENTS 4,009,837 3/1977 Schnyder ..... 241/93
4,077,450 3/1978 Ackerman ..... 241/93

FOREIGN PATENT DOCUMENTS 404818 1/1924 Germany ..... 241/93
44 14 222 6/1995 Germany .

*Primary Examiner*—Mour Rosenbaum
*Attorney, Agent, or Firm*—Herbert Dubno; Andrew Wilford

[57] ABSTRACT

A chipper has a housing formed with an intake defining a feed direction, a hollow drum rotatable in the housing in a rotational sense about an axis transverse to the feed direction and formed with a plurality of angularly spaced, radially throughgoing, and axially elongated windows, and a respective blade fixed to the drum immediately downstream in the sense from each window. The blades have edges defining on rotation of the drum an orbit. A breaker plate secured in the housing defines with the orbit a gap narrowing toward the drum and is formed with a plurality of wedges extending generally in the direction, having sharp edges directed generally radially at the drum, and spaced radially from the drum. A motor rotates the drum in the sense and thereby presses material fed in the direction into the housing against the wedges to split the material with the wedges, then draw it into the gap, and then comminute it with the blades.

18 Claims, 3 Drawing Sheets

30
18
25
24
26
17
15
22
14
5
31
9
M
8
21
23
20
19
5
A
10
3
11

CHIPPER

FIELD OF THE INVENTION

The present invention relates to a chipper. More particularly this invention concerns an apparatus for comminuting wooden branches and the like.

BACKGROUND OF THE INVENTION

A standard branch chipper as described in German patent 4,414,222 of H. Eckert et al has a housing formed with an intake defining a feed direction, a drum rotatable in the housing in a rotational sense about an axis transverse to the feed direction, and a plurality of blades fixed to the drum and having edges defining on rotation of the drum an orbit. A breaker plate secured in the housing defines with the orbit a gap narrowing toward the drum.

Thus branches and the like are fed in the direction to the rotating drum whose blades pull the branches into the gap and comminute them. As the workpiece, that is the branch, diameter increases the blades meet it at an increasingly perpendicular angle of attack, reducing the tendency to pull the branch into the machine and in some instances even throwing it back out of the feed funnel. Thus as branch diameter increases it becomes increasingly difficult to feed and operate the chipper. Once the branch diameter exceeds the cutting depth of the drum, that is the height of the orbit defined by the blade cutting edges above the surface of the drum, efficiency falls off considerably.

OBJECTS OF THE INVENTION

It is therefore an object of the present invention to provide an improved branch chipper.

Another object is the provision of such an improved branch chipper which overcomes the above-given disadvantages, that is which can readily comminute even relatively large-diameter branches.

SUMMARY OF THE INVENTION

A chipper has according to the invention a housing formed with an intake defining a feed direction, a hollow drum rotatable in the housing in a rotational sense about an axis transverse to the feed direction and formed with a plurality of angularly spaced, radially throughgoing, and axially elongated windows, and a respective blade fixed to the drum immediately downstream in the sense from each window. The blades have edges defining on rotation of the drum an orbit. A breaker plate secured in the housing defines with the orbit a gap narrowing toward the drum and is formed with a plurality of wedges extending generally in the direction, having sharp edges directed generally radially at the drum, and spaced radially from the drum. A motor rotates the drum in the sense and thereby presses material fed in the direction into the housing against the wedges to split the material with the wedges, then draw it into the gap, and then comminute it with the blades.

Thus with this system large-diameter branches are actually split by the wedges so they can be pulled down and chipped like smaller-diameter branches. The machine can therefore comminute relatively thick branches as well as thinner ones. The system of this invention therefore not only cuts the incoming material transversely of the feed direction, but also splits it parallel to this direction to make it easier to cross cut.

The wedges according to the invention have sharp edges which extend secantally of the drum and the plate is formed at ends of the wedges with a smooth surface equispaced from the orbit. This smooth surface extends to the sharp edges of the wedges.

The drum has an open end and the wedges extend parallel to each other and to the direction. While during normal use the breaker plate does not move at all, it is nonetheless mounted in the housing for limited pivoting. Means is provided for pivoting the breaker plate on the housing and for arresting it relative to the drum axis so that a radial dimension of the gap can be adjusted. This is done by a screw threaded in the housing and bearing radially of the axis on the breaker plate. Means is provided for inhibiting rotation of the screw to prevent the machine from maladjusting itself during use.

To facilitate movement of chips through the device the drum has a smooth inner surface. Each window has a radial dimension relative to the axis of between 30° and 60° and an axial dimension generally equal to an axial length of the respective blade.

The drum is cantilevered, that is carried by a shaft fixed in only one axial end of the drum. Normally the drum is generally frustoconical and flares away from the one axial end. Each blade has two opposite sharp edges and is releasably secured to the drum so it can be flipped when dull, doubling the time between times when it is necessary to replace or sharpen these blades.

The sharp edges of the wedges according to the invention extend at an angle of at most 30° to the feed direction. The drum is rotated at most 100 at revolutions per minute, normally 40 RPM being sufficient for most tasks so the machine is relatively quiet.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
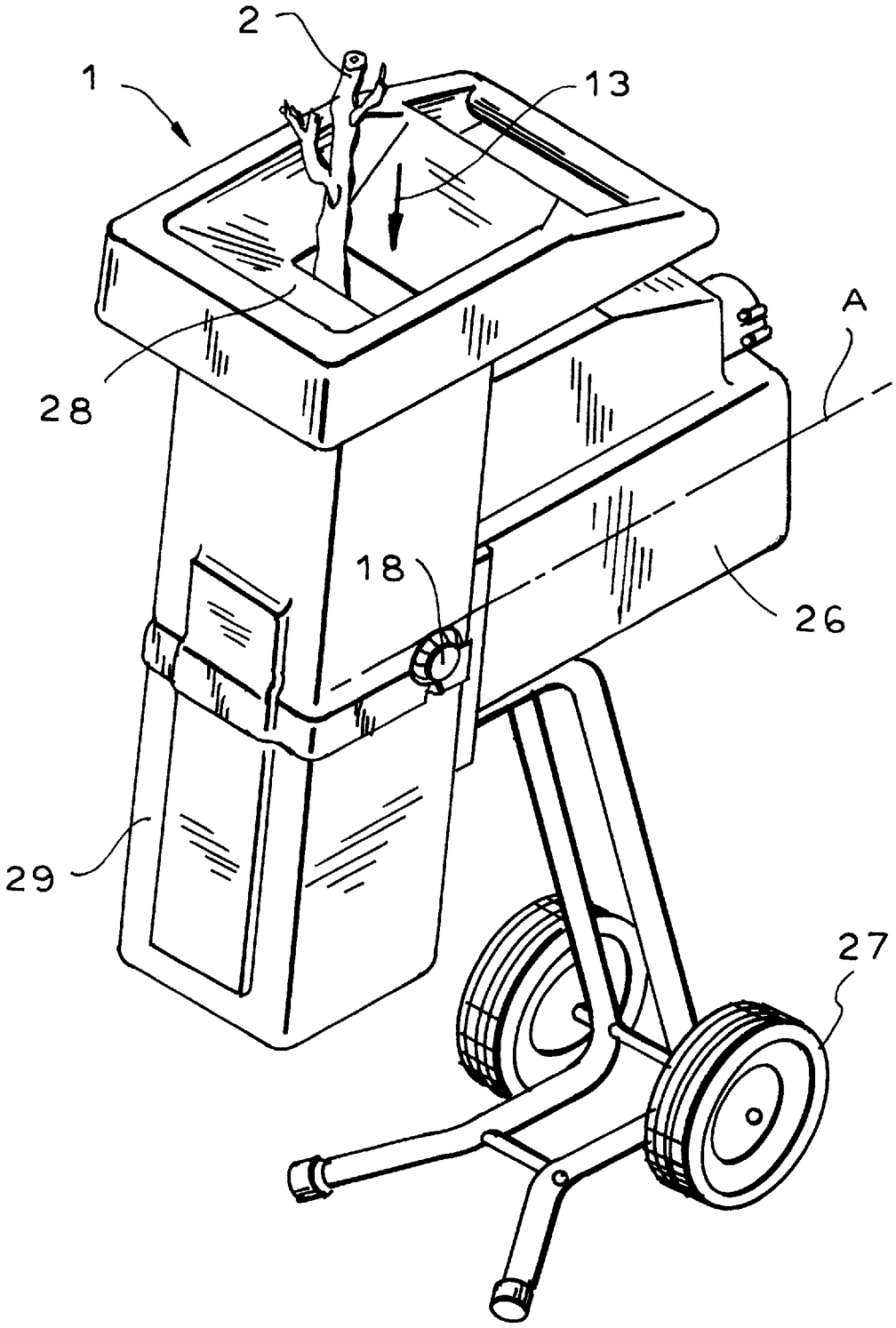
FIG. 1 is a perspective view of the chipper according to the invention.

As seen in FIG. 1 a chipper 1 has a housing 26 supported on wheels 27 and forming an upwardly open intake funnel 28. Branches 2 are inserted vertically in a direction 13 into the funnel 28 to be chopped into small pieces and dropped into a hopper 29.

Figure 2:
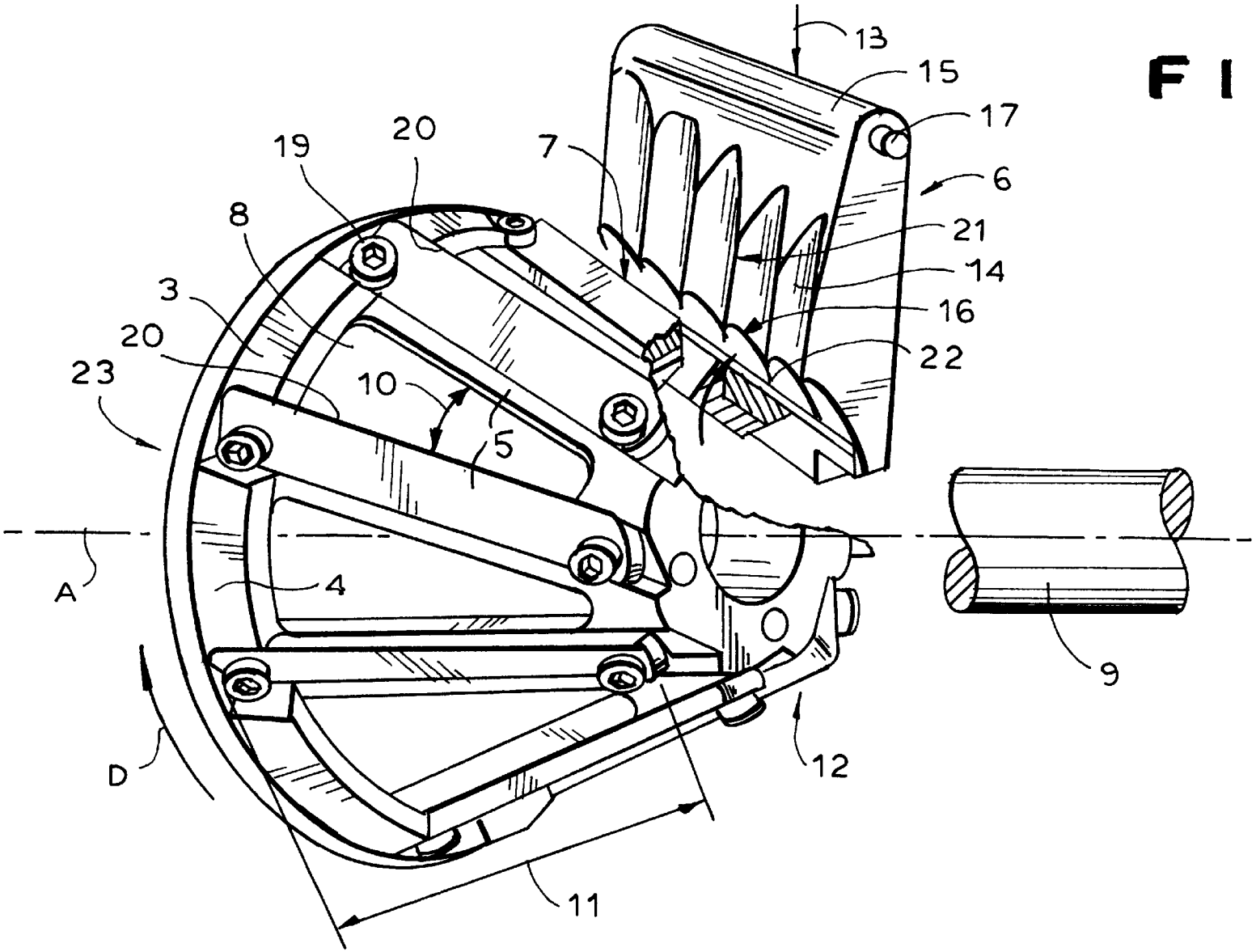
FIG. 2 is a partly exploded and partly sectional view of the comminuting elements of the chipper.
Figure 3:
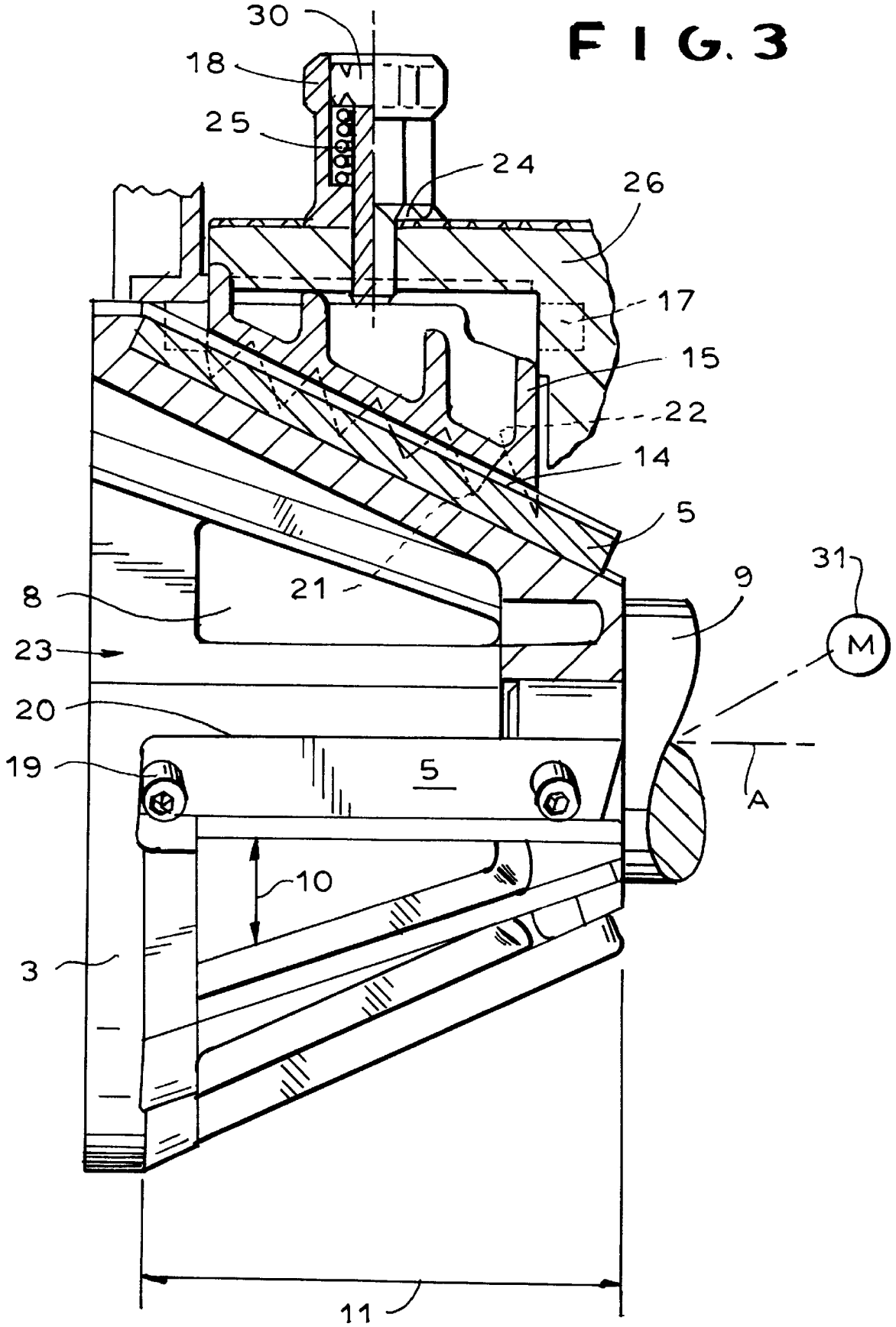
FIG. 3 is a top view partly in horizontal section through the structure of FIG. 2.

FIGS. 2 and 3 show a main chopper drum 3 rotatable about a horizontal axis A by a drive shaft 9 and of basically frustoconical shape centered on the axis A. The drum 3 is provided with eight axially extending and angularly equispaced blades 5 secured in place by screws 19 and each having an overall length 11. In addition the drum 3 is formed immediately upstream in a rotation direction D of the blades 5 with identical generally triangular openings or windows 8 that are radially throughgoing, of generally the same length 11 as the blades 5, and of a width 10 that increases axially toward an open end 23 of the drum 3 defined by a ring 4. More specifically each window has an angular dimension of between 30° and 45°, and in fact when fewer blades 5 are provided they can stretch up to 60°. The opposite narrower end 12 of the drum is closed and flanged to the shaft 9 connected to a motor shown schematically in FIG. 3 at 31. The blades 5 can have two sharpened edges 20 so they can be turned over and reused when dull. The interior of the drum 3 is smooth so that nothing catches on it.

A splitter plate 6 according to the invention extends generally in the direction 13 tangentially of the orbit of the blades 8 and is in fact limitedly pivotal on the housing 26 about an axis 17 above and parallel to the axis A and passing through an upper edge 15 of this plate 6. This plate 6 is formed with a plurality of sharp-edged wedges 14 having points 21 directed radially of the axis A and defining V-shaped grooves 22, the points 21 and grooves 22 extending parallel to the direction 13. A screw 30 threaded into the housing 26 bears radially inward of the axis A on the plate 6 and is surrounded by and rotationally coupled to a sleeve 18 having teeth 24 engaging with identical teeth on the housing 26. A spring 25 is braced between a head of the screw 30 and the sleeve 18 so that considerable torque has to be exerted on the screw 30 via this sleeve 18 to rotate the screw 30 and thereby disengage the teeth 24 and allow the radial position of the plate 6 to be adjusted.

The plate 6 has a cutoff portion 16 of part frustoconical shape that defines a uniform gap 7 with the orbit defined by the leading cutting edges of the blades 5. Both the wedges 14 and grooves 22 terminate in this smooth region 16.

The apparatus described above operates as follows:

The motor 31 rotates the drum 3 in the direction D at a speed of about 40 revolutions per minute. Branches 2 and the like are fed radially of the axis A to the drum 3 and, as they contact the blades 5, they are pushed against the breaker plate 6. If the branches 2 are of relatively small diameter they will be forced in between the wedges 14. The rotation of the drum 3 will move the branches 2 down in the grooves 22 and will chop them up into pieces no thicker than the radial dimension of the gap 16.

According to the invention if the branches 2 are of greater diameter they will be pressed radially against the wedges 14 which will split them into pieces that will be forced into the grooves 22. Thence the pieces will move down in the grooves 22 like thinner branches and be comminuted in the gap 16. Since the wedges 14 extend parallel to the feed direction and since most branches and the like will be fed in longitudinally, the grain direction of the workpieces will be parallel to the secantally or tangentially extending points 21 of the wedges 14 and they will split easily.

Regardless of the size of the branches 2 being comminuted, the pieces cut from them will enter the drum 3 via the windows 8. Thence they can either fall straight down and pass through the windows 8 out through the bottom of the drum 3, or can pass axially out through the open end 23.

I claim:

1. A chipper comprising:

a housing formed with an intake defining a feed direction;

a hollow drum rotatable in the housing in a rotational sense about an axis transverse to the feed direction and formed with a plurality of angularly spaced, radially throughgoing, and axially elongated windows;

a respective blade fixed to the drum immediately downstream in the sense from each window, the blades having edges defining on rotation of the drum an orbit;

a breaker plate secured in the housing, defining with the orbit a gap narrowing in the rotational sense, and formed with a plurality of wedges extending generally in the direction and secantally of the drum, having sharp edges extending in the feed direction, directed generally radially at the drum, and spaced radially from the drum; and means for rotating the drum in the sense and thereby pressing material fed in the direction into the housing against the wedges to split the material with the wedges, then draw it into the gap, and then comminute it with the blades.

2. The chipper defined in claim 1 wherein the plate being formed at ends of the wedges with a smooth surface equispaced from the orbit.

3. The chipper defined in claim 2 wherein the smooth surface extends to the sharp edges of the wedges.

4. The chipper defined in claim 1 wherein the drum has an open end.

5. The chipper defined in claim 1 wherein the wedges extend parallel to each other and to the direction.

6. The chipper defined in claim 1 wherein the breaker plate is limitedly pivotal on the housing.

7. The chipper defined in claim 6, further comprising means for pivoting the breaker plate on the housing and for arresting it relative to the drum axis, whereby a radial dimension of the gap can be adjusted.

8. The chipper defined in claim 7 wherein the pivoting means includes a screw threaded in the housing and bearing radially of the axis on the breaker plate.

9. The chipper defined in claim 8 wherein the pivoting means includes means for inhibiting rotation of the screw.

10. The chipper defined in claim 1 wherein the drum has a smooth inner surface.

11. The chipper defined in claim 1 wherein each window has a radial dimension relative to the axis of between 30° and 60°.

12. The chipper defined in claim 1 wherein each window has an axial dimension generally equal to an axial length of the respective blade.

13. The chipper defined in claim 1 wherein the rotating means includes a shaft fixed in only one axial end of the drum.

14. The chipper defined in claim 13 wherein the drum is generally frustoconical and flares away from the one axial end.

15. The chipper defined in claim 1 wherein each blade has two opposite sharp edges, the chipper further comprising means for releasably securing the blades to the drum adjacent the respective windows.

16. The chipper defined in claim 1 wherein the sharp edges of the wedges extend at an angle of at most 30° to the feed direction.

17. The chipper defined in claim 1 wherein the rotating means revolves the drum at most at 100 revolutions per minute.

18. The chipper defined in claim 1 wherein the axis is horizontal and the feed direction is vertical.

* * * * *